United States Patent [19]

Odell et al.

[11] 3,998,745

[45] Dec. 21, 1976

[54] METHOD FOR MANUFACTURING TRACTION MOTOR GEAR LUBRICANT

[75] Inventors: Norman R. Odell, Nederland; Melvin R. Hefty, Port Arthur; Clarence Vaughn, Groves; Arthur W. Wammel, Beaumont, all of Tex.

[73] Assignee: Texaco Inc., New York, N.Y.

[22] Filed: Feb. 12, 1975

[21] Appl. No.: 549,265

[52] U.S. Cl. ..... 252/41

[51] Int. Cl.[2] ..... C10M 1/24; C10M 3/18; C10M 5/14; C10M 7/20

[58] Field of Search ..... 252/35, 39, 41

[56] References Cited

UNITED STATES PATENTS

| | | | |
|---|---|---|---|
| 179,256 | 6/1876 | Billington | 252/41 |
| 3,015,624 | 1/1962 | Hencke et al. | 252/41 |
| 3,475,337 | 10/1969 | Green et al. | 252/41 |
| 3,790,479 | 2/1974 | Hommer | 252/41 |

FOREIGN PATENTS OR APPLICATIONS

| | | | |
|---|---|---|---|
| 601,346 | 5/1948 | United Kingdom | 252/41 |

*Primary Examiner*—Delbert E. Gantz
*Assistant Examiner*—I. Vaughn
*Attorney, Agent, or Firm*—T. H. Whaley; C. G. Ries; Kenneth R. Priem

[57] ABSTRACT

A method for manufacturing a semi-fluid lubricant resistant to shear thickening to a controlled apparent viscosity is provided wherein a soap base containing about 14% soap is shear thickened and then diluted with oil to a desired soap content. The use of a soap base containing about 14% soap as opposed to the usual method of using a soap base containing about 5% soap surprisingly results in a finished semi-fluid lubricant which will not appreciably increase in viscosity during the handling and packaging process.

5 Claims, No Drawings

METHOD FOR MANUFACTURING TRACTION MOTOR GEAR LUBRICANT

BACKGROUND OF THE INVENTION

1. Field of the Invention

This invention pertains to the manufacture of semi-fluid lubricants.

2. Description of the Prior Art

Semi-fluid lubricants such as traction motor gear lubricants are essentially mineral oils thickened by a low percentage of soap. The percentage of soap normally used in a finished product is between 2 and 3 percent. Traction motor gear lubricants are used, for example, in the diesel-electric locomotive. In such a locomotive, power is transmitted from the electric motor through a set of spur gears, a pinion gear on the motor shaft and a large ring gear attached to the axle of the locomotive. The entire gear arrangement is usually enclosed in a gear case which also serves as a lubricants reservoir. The lubricant in the case is maintained at a level to partially submerge the ring gear. Consequently, the lubricant must have a viscosity so that it is fluid enough to seek its own level in the bottom of the case, but adhesive enough to both cling to the gears and resist leakage from the case. Therefore, recently users of these traction motor gear lubricants have related performance of the lubricants to the apparent viscosity and not the penetration value as was formerly the case.

The conventional method of controlling the consistency of traction motor gear lubricants was to manufacture to a specific worked penetration (method ASTM D217). However, viscosity tests results on traction motor gear lubricants which were manufactured to a specified worked penetration value were consistently far above the specified viscosity requirements. In a specific application where a viscosity of 5,000 to 15,000 CP was required, only five of 14 batches or 36% complied, immediately after manufacture but before packaging. Seven percent exceeded the 15,000 CP maximum limit and eight batches were below the 5,000 CP limit before packaging. However, after packaging, during which the lubricants were subjected to additional shear, viscosities ranged from 39,000 to 50,000 CP, far above the acceptable limits imposed by the new viscosity requirement.

These high apparent viscosity values of the traction motor gear lubricants were related to shear thickening experienced during handling subsequent to manufacture including the packaging operation which consisted of filling polyethylene bags.

Generally during the polyethylene bag filling operation, it is necessary to maintain the temperature of the lubricant at about 130°. The desired uniform temperature is maintained in the tank car by using a gear pump to continuously recirculate the lubricant through an outside line from the bottom of the tank into the top of the tank car. The temperature of the lubricant is maintained in the tank car by instrument controlled internal heating coils. A line leading from the circulation loop fed the bagging machine. For satisfactory function of the bagging operation, it is necessary to maintain a bag pressure of approximately 85 psig on the circulation loop. It is evident that the traction gear lubricants manufactured according to classical procedure shear thickened excessively during the packaging operation and could not be packaged to the proposed apparent viscosity requirements.

In the prior art method, a concentrated soap base containing about 5 to 6 percent soap with the balance being oil was shear thickened and then diluted to attain a required final soap content, usually between 2 and 3 percent. Since traction gear lubricants manufactured by this method shear thickened to excessive apparent viscosities, it became necessary to develop a manufacturing method whereby the penetration value of the finished lubricant would not be altered and yet the viscosity would fall within the range of specifications. This also required that the finished semi-fluid lubricant contained the same 2 to 3 percent soap concentration.

SUMMARY OF THE INVENTION

The invention is a method for manufacturing a semi-fluid lubricant resistant to shear thickening to a controlled apparent viscosity wherein a soap base containing from about 10 to 30 percent soap and about 70 to 90 percent oil is shear thickened and then diluted with oil to a desired soap content.

DESCRIPTION OF THE PREFERRED EMBODIMENTS

This invention is a method of manufacturing a traction gear lubricant by controlling the soap content of the soap base to a value higher than formerly used and then manufacturing to a controlled apparent viscosity. To control shear thickening, this soap fiber must be sufficiently dispersed in the oil during the shearing of the soap base to minimize shear thickening on subsequent handling. Generally, the classical teaching was that an increased soap content would increase the viscosity of the resulting lubricant. It was surprising, therefore, to discover that where the soap content of the soap base was increased from 6 to 14 weight percent and then shear thickened and subsequently diluted with oil to a soap concentration of 2 to 3 weight percent, a semi-fluid lubricant resulted which had a viscosity of between 5,000 and 15,000 cp after packaging. Where a soap base of 5 to 6 weight percent was shear thickened and then diluted to a soap content of 2 to 3 weight percent, the viscosity ranged between 39,000 and 50,000 cp after packaging.

This difference is dramatic and even more surprising when it is noted that the penetration value is not appreciably affected.

Generally, the following procedure may be used to form acceptable semi-fluid lubricants by the process of our invention. A metal oxide, hydroxide or carbonate is stirred and heated in a kettle with a fatty oil or fatty acid to saponify the ingredients. The percentage of soap in this soap base is from 10 to 30 weight percent and preferably about 14 weight percent. After this, the mixture is stirred and heated at a higher temperature to dehydrate the soap base. After dehydration, continued stirring proceeds and the balance of the base oil is added to achieve the desired final soap concentration of between 2 and 3 weight percent. At this point, of course, any additives needed to achieve final grease properties may be added by methods known to the art. A semi-fluid lubricant made according to this procedure will not appreciably increase in apparent viscosity during the subsequent handling of the packaging operation.

A detailed procedure for making a semi-fluid lubricant of our invention follows in Table I.

TABLE I

A PROCEDURE FOR PREPARING SEMIFLUID LITHIUM 12-HYDROXYSTEARATE GREASE RESISTANT TO SHEAR THICKENING

1. Charge the following to a kettle: lithium hydroxide solution, hydrogenated castor oil, and that percentage of the base oils that will give the desired soap concentration in the soap base (10–30 wt %, preferably about 14 wt %).
2. Stir and heat this mixture to 190°–200° F and hold for a 1 to 2 hour period to saponify.
3. Stir and heat this soap base to 270°–330° F to dehydrate and hold at that temperature until dehydration is completed.
4. Stop heating and bleed steam jacket.
5. Continue stirring and add the balance of the base oil as required to achieve the desired final soap concentration (2–3%).
6. Add additives needed to achieve desired final grease properties at an appropriate temperature.
7. Run control Brookfield apparent viscosity on the lubricant. If the apparent viscosity complies with requirements, the batch is finished.
8. If the apparent viscosity of the control sample is too low, circulation shear the batch until the product complies with the viscosity range requirement.
9. If the apparent viscosity is too high, dilute the batch with the required base oils and additives until the product complies with the viscosity range requirement.

In step 1, the soap content of the soap base is controlled to about 14 weight percent. The soap content range of the soap base may be from about 10 to 30 weight percent (previously soap content of soap base was approximately 5 to 6 weight percent).

In step 3, elapsed time periods from completion of saponification to completion of dehydration may vary appreciably. Dehydration periods in small kettles of 10,000 pound batches or less have been relatively short (about 2 hours). However, for larger batches (40,000 pound batches) the dehydration periods have varied considerably. In general, heating from 315° to 325° F and holding for about a 1 hour period appears to be optimum.

In Table II, it may be noted that batches A and B made by the prior art method beginning with a soap base of 5 to 6 percent were packaged with an apparent viscosity of approximately 50,000 CP. However, batches C, D and E which were made according to the method of the invention using a soap base containing from 14–15% soap had viscosity values generally in the desired 5,000 to 15,000 CP range after packaging.

The soap used to make greases of this invention may be made by saponification of various fats, fatty acids, derivatives of fats and oils such as fatty acid derived from vegetable, animal, marine and fish oils, and hydrogenated fatty acids thereof, preferably containing from 8 to 40 carbon atoms, synthetic fatty acids produced from hydrocarbon, naphthenic acids, rosin acids, tall oil acids and the like.

The natural fats and fatty acid materials derived therefrom which can be used to form soaps include:

I. Animal:
Tallow (bee, mutton goat) etc. lard oil, bone oil, neat's foot oil, wool fat, horse fat oil, etc.

II. Vegetable Oils:
Castor oil, cashew nut oil, peanut oil, cocoanut oil, jojoba seed oil, olive oil, palm oil, corn oil, cottonseed oil, rapeseed oil, ravison oil, sesame oil, soyabean oil, linseed oil, etc.

III. Marine and fish oils:
Codfish oil, codliver oil, dog fish oil, dolphin oil, herring oil, memhaden oil, porpoise oil, salmon oil, sardine oil, seal oil, shark oil, whale oil, etc.

IV. Hydrogenated residuum or distillate fractions obtained from any of the oils listed above.

V. Specific fatty acids which can be used to form the soap may include saturated alkyl monocarboxylic acids:
Capric, undecyclic, lauric, myristic, palmitic, stearic, arachidic, lignoceric, montanic, melistic acids, etc.

Va. Unsaturated alkyl monocarboxylic acids:
Oleic, linoleic, erucic, clupanodonic, linolenic, brassidic, elaidic, elacosteanic, stearoleic acids, etc.

The soap may be made by saponifying the above type fatty materials, their mixtures, with metal oxide, hydroxides, carbonates, etc., or in the presence of several metal compounds, or organic bases.

A. Metals selected from the period table, e.g.,
Group I — lithium, sodium, potassium, rubidium, cesium
Group II — calcium, strontium, barium, magnesium, zinc and cadmium.

The lubricating oils forming the major constituent of these compositions may be any oils of lubricating characteristics which are suitable for use in lubricating compositions generally. Such oils include the conventional mineral lubricating oils having Saybolt Universal viscosities in the range from about 75 seconds at 100° F to about 2250 seconds at 210° F, which may be either naphthenic or paraffinic in type or blends of different oils. The preferred lubricating oils are those having Saybolt Universal viscosities in the range from about 300 seconds at 100° F to about 1000 seconds at 210° F, which may be blends of lighter and heavier oils in the lubricating oil viscosity range. Synthetic lubricating oils, which may be preferred for obtaining greases having special properties required for certain types of lubricating service, including oils prepared by cracking and polymerizing products of the Fischer-Tropsch process and the like as well as other synthetic oleaginous compounds such as polyethers, polyesters, silicone oils, etc., having viscosities within the lubricating oil viscosity range. Suitable polyethers include particularly polyalkylene glycols such as polyethylene glycol. Suitable polyesters include the aliphatic dicarboxylic acid diesters, such as di-2-ethylhexyl sebacate, di (secondary amyl) sebacate, di-2-ethylhexyl azelate, di-iso-octyl adipate, etc. The sulfur analogs of the polyalkylene ethers and polyesters are also suitable.

TABLE II

SEMI-FLUID LUBRICANTS

| Batch No. | A | B | C | D | E |
|---|---|---|---|---|---|
| Kettle No. | 18 | 19 | 19 | 18 | 18 |
| Approx. Batch Size, Lb | 44,000 | 39,000 | 39,000 | 39,000 | 40,000 |
| Soap Base, Wt% Soap | 6 | 5 | 14.6 | 14 | 14 |

TABLE II-continued

| SEMI-FLUID LUBRICANTS | | | | | |
|---|---|---|---|---|---|
| Batch No. | A | B | C | D | E |
| Finished Product | | | | | |
| Soap Content Wt. % | 3.1 | 2.6 | 2.6 | 2.8 | 2.6 |
| EMD Brookfield Vis. CP | 4,500 | 12,000 | 6,000 | 5,500 | 6,500 |
| EMD Brookfield Vis. CP | | | | | |
| Tank Car, Avg. | | 14,000 | 6,100 | 7,580 | 7,660 |
| In Polyethylene Bags, Avg. | 49,500 | 50,000 | 7,500 | 8,750 | 14,000 |

We claim:

1. A method for manufacturing a semi-fluid lubricant to a controlled apparent viscosity comprising
   shearing a lithium soap base of about 14% soap content to disperse the soap and thicken the base and
   diluting the soap base with lubricating oil to a soap content which results in a viscosity of from about 5,000 to 15,000 CP.

2. A method as in claim 1 wherein the soap is made from lithium hydroxide and hydrogenated castor oil and the final soap content is from 2 to 3 percent.

3. A method for manufacturing a semi-fluid lubricant resistant to shear thickening to a controlled apparent viscosity of about 5,000 to 15,000 CP wherein a soap base is shear thickened and then diluted with oil to a final soap content the improvement which comprises
   shearing a lithium soap base containing about 14 percent soap.

4. A method as in claim 3 wherein the soap is made from lithium hydroxide and hydrogenated castor oil and the final soap content is from about 2 to 3 percent.

5. A method for manufacturing a semi-fluid lubricant to a controlled apparent viscosity of about 5,000 to 15,000 CP comprising
   a. stirring a mixture of lithium hydroxide, hydrogenated castor oil and base oil at a temperature of from 190°–200° F for from about 1 to 2 hours wherein the resulting soap content will be about 14 weight percent;
   b. dehydrating the mixture of (a) by heating it at a temperature of from 270°–330° F, and
   c. adding base oil to achieve a final soap content of from about 2 to 3 weight percent after heating is stopped.

* * * * *